US008468767B1

(12) United States Patent
McBride

(10) Patent No.: US 8,468,767 B1
(45) Date of Patent: Jun. 25, 2013

(54) WALL PANEL SYSTEM AND METHOD OF ASSEMBLING THE SAME

(75) Inventor: Steven J. McBride, Newcastle, WA (US)

(73) Assignee: Vertical Dimensions, LLC, Seattle, WA (US)

( * ) Notice: Subject to any disclaimer, the term of this patent is extended or adjusted under 35 U.S.C. 154(b) by 234 days.

(21) Appl. No.: 12/782,559

(22) Filed: May 18, 2010

Related U.S. Application Data

(60) Provisional application No. 61/179,302, filed on May 18, 2009.

(51) Int. Cl.
*E04B 2/00* (2006.01)

(52) U.S. Cl.
USPC ..... 52/586.2; 52/582.1; 52/513; 52/461; 52/471

(58) Field of Classification Search
USPC ..... 52/461, 471, 475.1, 763, 764, 774, 52/777, 779, 781, 509, 513, 586.2, 582.1, 52/302.3, 243, 512
See application file for complete search history.

(56) References Cited

U.S. PATENT DOCUMENTS

| | | | | |
|---|---|---|---|---|
| 652,051 | A * | 6/1900 | Streifler | 52/271 |
| 4,094,113 | A * | 6/1978 | Good | 52/222 |
| 4,394,809 | A * | 7/1983 | Sherwood et al. | 52/512 |
| 4,516,373 | A * | 5/1985 | Osawa | 52/387 |
| 5,251,996 | A * | 10/1993 | Hiller et al. | 403/331 |
| 6,098,364 | A * | 8/2000 | Liu | 52/506.08 |
| 6,170,214 | B1 * | 1/2001 | Treister et al. | 52/511 |
| 6,430,883 | B1 * | 8/2002 | Paz et al. | 52/235 |
| 7,043,884 | B2 * | 5/2006 | Moreno | 52/235 |
| 7,089,708 | B1 | 8/2006 | Bostock | |
| 7,743,575 | B2 * | 6/2010 | Ito | 52/582.1 |
| 8,051,623 | B2 * | 11/2011 | Loyd | 52/747.1 |
| 2003/0019174 | A1 * | 1/2003 | Bolduc | 52/290 |
| 2006/0254171 | A1 | 11/2006 | Bostock | |

* cited by examiner

*Primary Examiner* — Jeanette E Chapman
*Assistant Examiner* — James Buckle, Jr.
(74) *Attorney, Agent, or Firm* — Christensen O'Connor Johnson Kindness PLLC

(57) ABSTRACT

A wall panel system includes a first wall panel and a second wall panel. The first wall panel has a first groove extending along a first end portion and a second groove extending along a second end portion. The second wall panel has a third groove extending along a third end portion. The wall panel system further includes a spline including first and second spline tongues, wherein the first spline tongue is mateable with the first groove and the second spline tongue is mateable with the third groove.

20 Claims, 8 Drawing Sheets

WALL PANEL SYSTEM AND METHOD OF ASSEMBLING THE SAME

CROSS-REFERENCE TO RELATED APPLICATION

This application claims the benefit of U.S. Provisional Patent Application No. 61/179,302, filed on May 18, 2009, the disclosure of which is hereby expressly incorporated herein by reference.

BACKGROUND

Wall paneling, for example, for elevator interiors and other rooms requiring wall paneling are generally custom-installed systems requiring a skilled installation crew. Recent developments have been made in unassembled wall panel systems that can be delivered and installed by general contractors without requiring training in custom installation.

For example, one unassembled wall panel system incorporates a tongue and groove system for an interlocking assembly, as described in U.S. Pat. No. 7,089,708, issued on Aug. 14, 2006, and U.S. Patent Application Publication No. 2006/0254171 A1, published on Nov. 16, 2006, both assigned to Bostock Company, Inc, the disclosures of which are hereby expressly incorporated by reference. In that regard, the panels are manufactured with a tongue extending from one end of the panel to engage with a groove in an adjacent panel. One disadvantage of this system is that the tongues on the panels are susceptible to breakage during installation and in transit.

Another unassembled wall panel system incorporates a "French cleat system." The French cleat system uses extruded wall cleats that are mateable with correspondingly-shaped wall panel cleats. To assembly the system, the wall cleats are first secured to the wall in precise locations, and the wall panels are thereafter mated with the wall cleats by carefully aligning the wall panel cleats with the wall cleats. This process is extremely time consuming and cumbersome.

Therefore, there exists a need for an improved wall panel system that does not require custom installation, that is less susceptible to breakage, and that is easy to install.

SUMMARY

The present disclosure provides a wall panel system includes a first wall panel and a second wall panel. The first wall panel has a first groove extending along a first end portion and a second groove extending along a second end portion. The second wall panel has a third groove extending along a third end portion. The wall panel system further includes a spline including first and second spline tongues, wherein the first spline tongue is mateable with the first groove and the second spline tongue is mateable with the third groove.

The present disclosure further provides a method of assembling a wall panel system on a wall. The method includes: (a) providing a first wall panel having a first groove extending along a first end portion and a second groove extending along a second end portion; (b) providing a second wall panel having a third groove extending along a third end portion; (c) providing a spline having first and second spline tongues; (d) mating the first spline tongue with the first groove; (e) securing the spline to a wall; and (f) mating the second spline tongue with the third groove.

The present disclosure further provides a spline for securing a first wall panel to a second wall panel. The first wall panel has a first groove extending along a first end portion and a second groove extending along a second end portion. The second wall panel has a third groove extending along a third end portion of the second wall panel. The spline includes first and second spline tongues, the first spline tongue mateable with the first groove of the first wall panel and the second spline tongue mateable with the third groove of the second wall panel.

The present disclosure further provides a pad stud assembly for securing a portion of a wall panel system to a wall and for selectively hanging a pad on the wall. The pad stud assembly includes a pad stud and a pad stud receiving portion. The pad stud receiving portion has an opening configured to receive a portion of a fastener and a portion of the pad stud.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Figure 1:
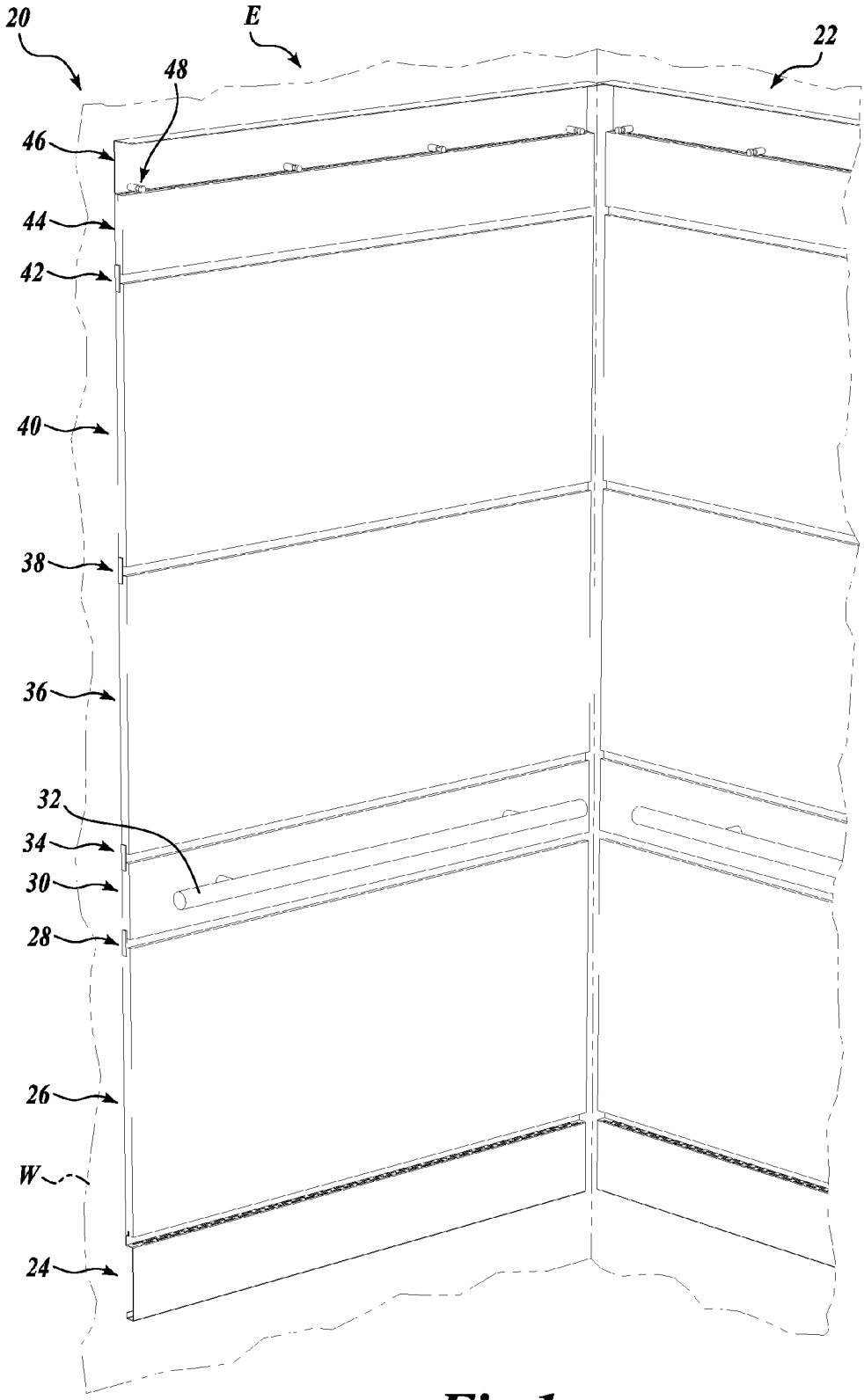
FIG. 1 is an isometric view of a wall panel system formed in accordance with a preferred embodiment of the present disclosure.

A wall panel system 20 formed in accordance with a preferred embodiment of the present disclosure may best be seen by referring to FIG. 1. The wall panel system 20 includes components for easily, quickly, and securely installing wall panels onto a wall or another flat surface. FIG. 1 depicts the wall panel system 20 secured to the interior wall W of an elevator E to provide a finished, aesthetically pleasing elevator interior. However, it should be appreciated that the wall panel system 20 may instead be used for finishing any relatively flat surface, such as the interior walls or ceiling of a building, the interior walls or ceiling of a vehicle, etc. Thus, the following description should not be seen as limiting the scope of the claimed subject matter. Furthermore, from time to time throughout this description, directional terms such as "upper," "lower," "horizontal," "vertical," etc., may be used to describe components of the wall panel system 20. It should be appreciated that use of such terms are for illustrative purposes only, and shall not be construed as limiting the scope of the present disclosure.

Referring to FIG. 1, the wall panel system 20 will first be generally described. Although the components of the wall panel system 20 may be secured to the wall W in any suitable order, the wall panel system 20 will be hereinafter described as being assembled from the bottom of the wall W (i.e., at the intersection of the wall W and floor F) up towards the top of the wall W near the ceiling (not shown) of the elevator E. The wall panel system 20 includes a base pan 24 that engages the wall W and floor F along a bottom portion of the base pan 24 and engages a bottom portion of a first wall panel 26 along a top portion of the base pan 24. A top portion of the first wall panel 26 is secured to a bottom portion of a second wall panel 30 through a first spline assembly 28. The second wall panel 30 may include a hand rail 32 secured to its exterior surface in a manner well known in the art.

An upper portion of the second wall panel 30 is secured to a bottom portion of a third wall panel 36 through a second spline assembly 34. Likewise, the third wall panel 36 is secured to a fourth wall panel 40 through a third spline assembly 38, and the fourth wall panel 40 is secured to a fifth wall panel 44 through a fourth spline assembly 42. It should be appreciated that any suitable number and size and configuration of wall panels may be used to accommodate different sizes and configurations of elevators E.

Near the top of the elevator E, a frieze 46 is secured along an upper portion of the fifth wall panel 44. The frieze 46 is configured to interface with a ceiling portion (not shown) of the elevator E to visually close off the upper portion of the wall W. The frieze 46 further includes a plurality of pad stud assemblies 48 that are configured to help secure the frieze 46 to the wall W and are further configured to provide a mounting structure for an elevator pad.

A portion of a second wall panel system 22 substantially identical to the wall panel system 20 is shown mounted to a second wall (not labeled) on the interior of the elevator E. It should be appreciated that the wall panel systems 20 and 22 may instead be of different configurations to provide differences in aesthetic design, and more than one wall panel system may instead be mounted to a single wall. It should further be appreciated that the gap defined between the wall panel systems 20 and 22 in the corner of the wall, as well as any other gaps defined between wall panel systems or between wall panel systems and portions of the wall W may be covered with a cover plate or other suitable device. For instance, a stainless steel reveal cover that is L-shaped in cross-section may be first secured in the corner of the wall W before installing the wall panel systems 20 and 22.

Figure 2:
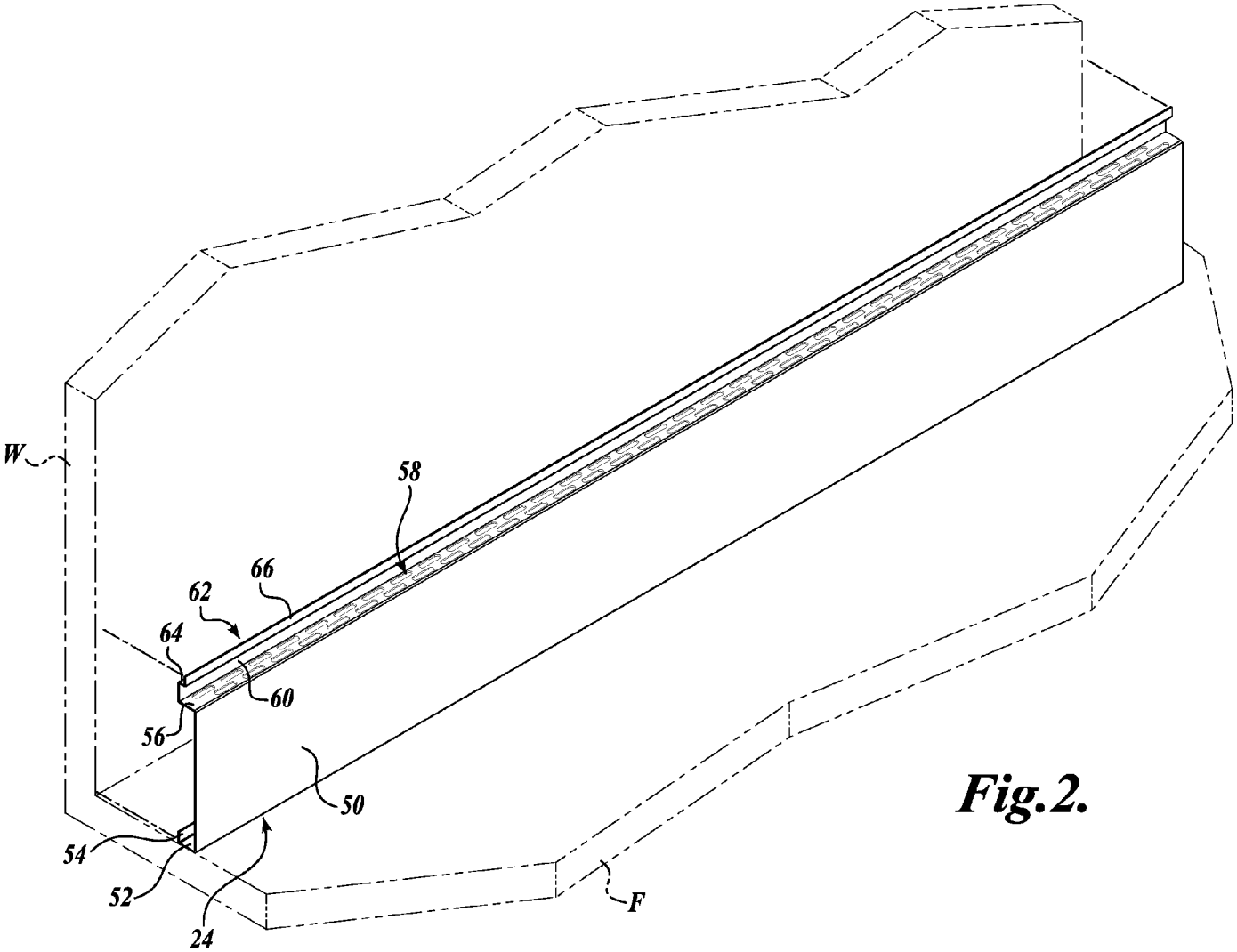
FIG. 2 is an isometric view of the base pan of the wall panel system of FIG. 1.

Referring to FIG. 2, the base pan 24 will now be described in detail. The base pan 24 is an elongated structure of any suitable material having a substantially constant cross-section. Preferably, the base pan 24 is made from an aesthetically pleasing material to provide a base trim for the elevator interior. However, the base pan 24 is also preferably made from a sturdy material to help resist damage or scratches cause by elevator use. For instance, the base pan 24 may be made from stainless steel, plastic, or another suitable material. It should be appreciated that if the base pan 24 becomes damaged during elevator use, it may be easily replaced.

The base pan 24 includes a substantially flat, elongated base pan body 50 and a floor engaging portion 52 that extends substantially transversely from a bottom edge of the base pan body 50 towards the wall W. A lower wall engaging portion 54 extends substantially transversely upwardly from an inner edge of the floor engaging portion 52. The floor engaging portion 52 and lower wall engaging portion 54 are configured to engage the floor F and wall W, respectively, at the intersection of the wall W and floor F. As such, the floor engaging portion 52 and lower wall engaging portion 54 space the base pan body 50 a predetermined distance from the wall W and position the base pan body 50 in a substantially parallel relationship to the wall W.

The base pan 24 further includes a vent portion 56 extending substantially transversely from an upper edge of the base pan body 50 towards the wall W. An upper wall engaging portion 60 extends substantially transversely upwardly from an inner edge of the vent portion 56. The vent portion 56 is substantially the same depth as the floor engaging portion 52 such that when the lower and upper wall engaging portions 54 and 60 abut the wall W, the base pan body 50 is positioned substantially parallel to the wall W.

The vent portion 56 includes a plurality of vent holes 58 formed along its length to place the gap defined between the wall W and the interior surface of the base pan body 50 into fluid communication with the interior of the elevator E. As such, the base pan 24 can vent any air flowing from the building heating, ventilation, and air conditioning system into the interior of the elevator E, as required by elevator or building codes.

It should be appreciated that the vent portion and vent holes may instead be formed along any other portion of the base pan 24. As a first alternative, the vent holes may be formed in the base pan body 50. As yet another alternative, the vent holes may be formed along the length of the floor engaging portion 52, and the base pan 24 may instead be mounted to the wall W such that the floor engaging portion 52 is spaced a predetermined distance from the floor F. In this alternative configuration, the lower wall engaging portion 54 may instead extend substantially transversely downwardly from the inner edge of the floor engaging portion 52.

The base pan 24 may be secured to the wall W in any suitable manner. For instance, a piece of double-sided tape, construction glue, or silicone adhesive may be disposed between the lower and upper wall engaging portions 54 and 60 and the wall W. In the alternative or in addition thereto, fasteners may be passed through holes (not shown) formed in the upper wall engaging portion 60, or the fasteners may instead be passed through the lower wall engaging portion 54 if it extends downwardly from the inner edge of the floor engaging portion 52 in the alternative configuration described above.

Figure 3:
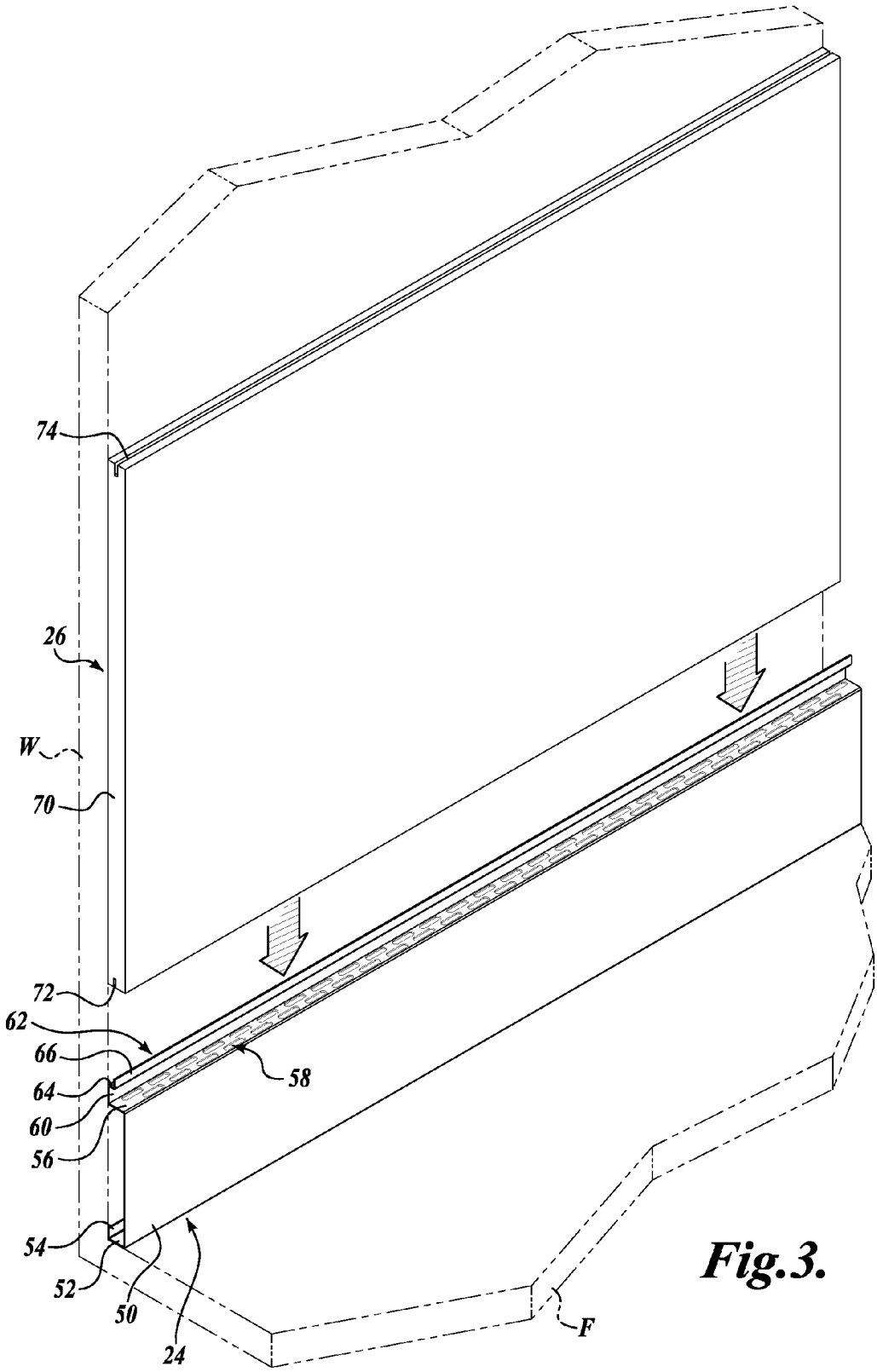
FIG. 3 is an isometric view of the base pan of FIG. 2 being mated with a first wall panel of the wall panel system of FIG. 1.

Referring to FIGS. 2 and 3, the base pan 24 is further securable to the first wall panel 26 through a base pan tab 62 defined along an upper edge of the upper wall engaging portion 60. The base pan tab 62 includes a horizontal portion 64 extending substantially transversely from an upper edge of the upper wall engaging portion 60 away from the wall W. The base pan tab 62 further includes a vertical portion 66 extending substantially transversely upwardly from an outer edge of the horizontal portion 64. The horizontal portion 64 is of a predetermined depth to position the vertical portion 66 to engage a first bottom groove 72 formed along the length of a bottom surface of the first wall panel 26.

Referring to FIG. 3, the first wall panel 26 includes a substantially rectangular first wall panel body 70 made of any suitable material, such as wood or a wood composite. The first wall panel body 70 includes a substantially flat inner surface such that it may engage and be positioned against and secured to the wall W. The exterior surface of the first wall panel body 70, or the surface facing toward the interior of the elevator E, may be flat or any suitable contour as desired for aesthetic or functional purposes.

The first wall panel body 70 defines a bottom elongated surface (not shown), and the first bottom groove 72 is formed along the length of the bottom elongated surface. Preferably, the first bottom groove 72 is formed in substantially the center of the bottom elongated surface (i.e., between the inner and outer surfaces of the first wall panel body 70) to provide structural integrity at the intersection of the first wall panel body 70 and the base pan tab 62. As can be seen in FIG. 3, with the first wall panel body 70 positioned against the wall W, the first wall panel 26 may be slid downwardly until the first bottom groove 72 engages the base pan tab 62 to mate the first wall panel 26 with the base pan 24.

Figure 4:
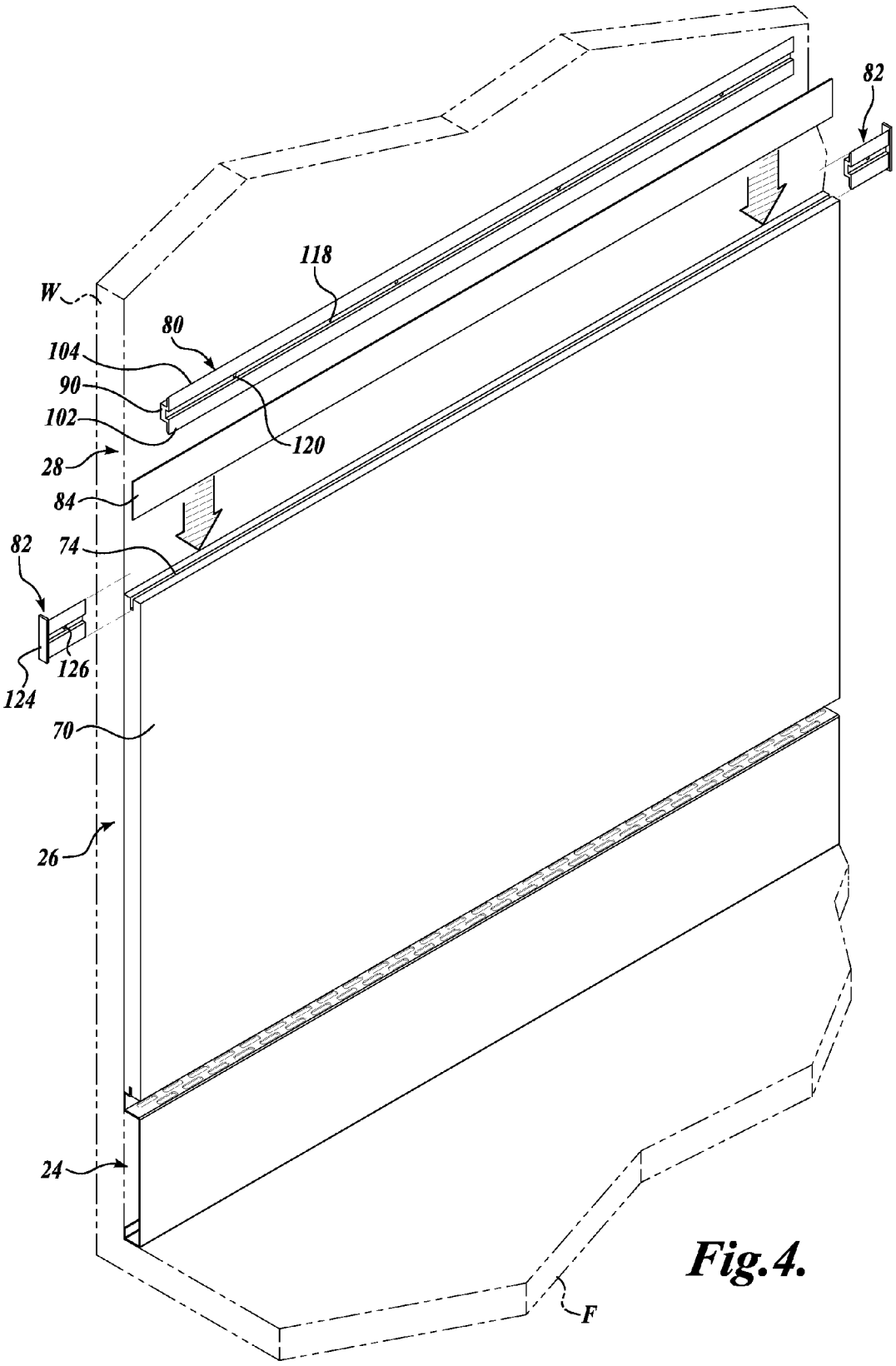
FIG. 4 is an isometric view of the base pan mated with the first wall panel of FIG. 2, wherein a first spline assembly is shown being mated with the first wall panel.
Figure 7:
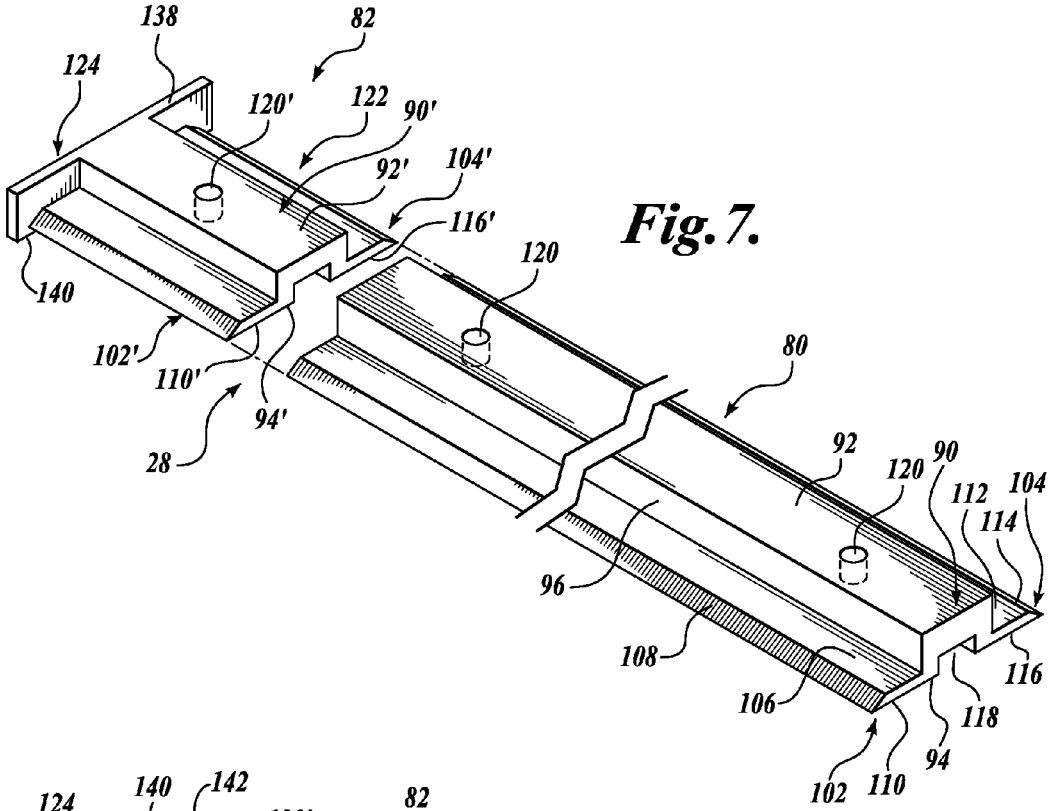
FIG. 7 is an isometric top view of a spline assembly formed in accordance with a preferred embodiment of the present disclosure.
Figure 8:
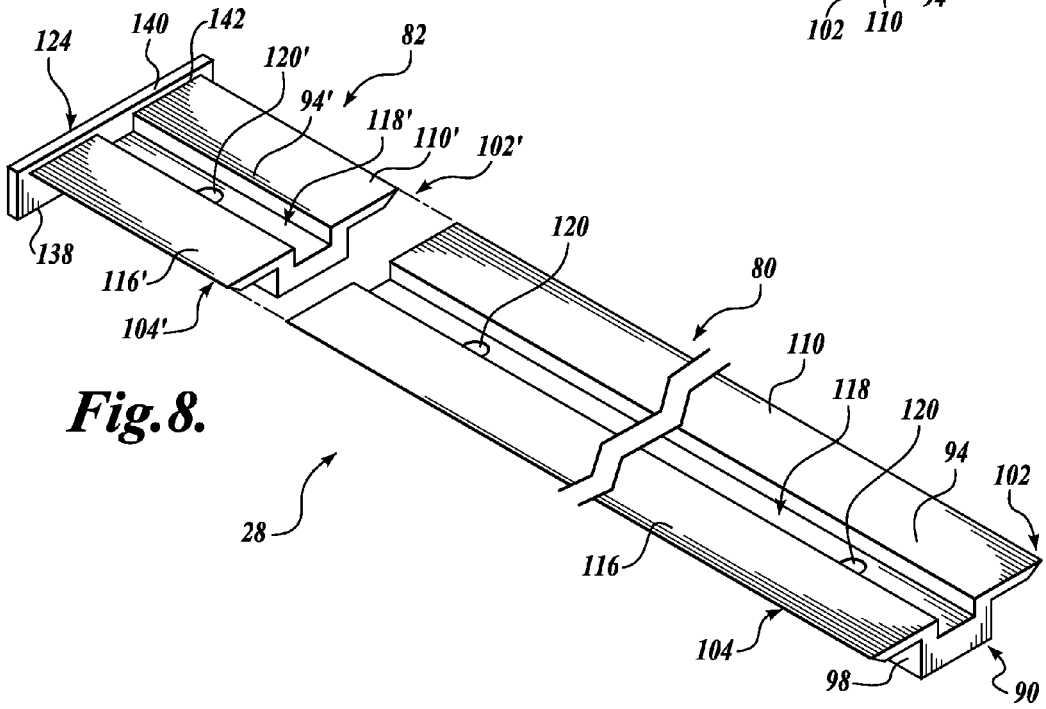
FIG. 8 is an isometric bottom view of the spline assembly of FIG. 7.

Referring to FIG. 4, the first wall panel 26 further includes a first top groove 74 extending along the length of the top surface of the first wall panel body 70. The first top groove 74 is sized and configured to mate with a portion of the first spline assembly 28. Referring additionally to FIGS. 7 and 8, the first spline assembly 28 includes a spline 80, an end cap 82, and a cover plate 84. The spline 80 is an elongated polygonal shaped part having substantially uniform cross section. The spline 80 is preferably made from a suitable metal, such as aluminum. Moreover, the spline 80 may be extruded so as to define an elongated part of substantially uniform cross section.

The cross-sectional shape of the spline 80 defines a central rectangular portion 90 having an inner wall engaging surface 92, an opposite outer surface 94, and first and second side surfaces 96 and 98 extending from the inner wall engaging surface 92. An elongated recess 118 is formed within the outer surface 94 of the central rectangular portion 90, and a plurality of holes 120 are formed within the recess 118 and extend through to the inner wall engaging surface 92 of the rectangular portion 90. The elongated recess 118 is of a predetermined depth to house the heads of fasteners passing through the holes 120 when securing the spline 80 to the wall W.

First and second lateral tongues 102 and 104 extend substantially transversely outwardly from the first and second side surfaces 96 and 98 of the central rectangular portion 90. The first lateral tongue 102 defines a first inner tongue surface 106 that is substantially parallel to the inner wall engaging surface 92 of the central rectangular portion 90. The first lateral tongue 102 further includes a first outer tongue surface 110 that is substantially flush with or otherwise forms an extension of the outer surface 94 of the central rectangular portion 90. A first tapered edge 108 extends downwardly and outwardly from the first inner tongue surface 106 towards the first outer tongue surface 110.

Likewise, the second lateral tongue 104 includes a second inner tongue surface 112 that is substantially parallel to the inner wall engaging surface 92 of the central rectangular portion 90. The second lateral tongue 14 also includes a second outer tongue surface 116 that is substantially flush with or otherwise forms an extension of the outer surface 94 of the central rectangular portion 90. A second tapered edge 114 extends downwardly and outwardly from the second inner tongue surface 112 towards the second outer tongue surface 116.

Figure 5:
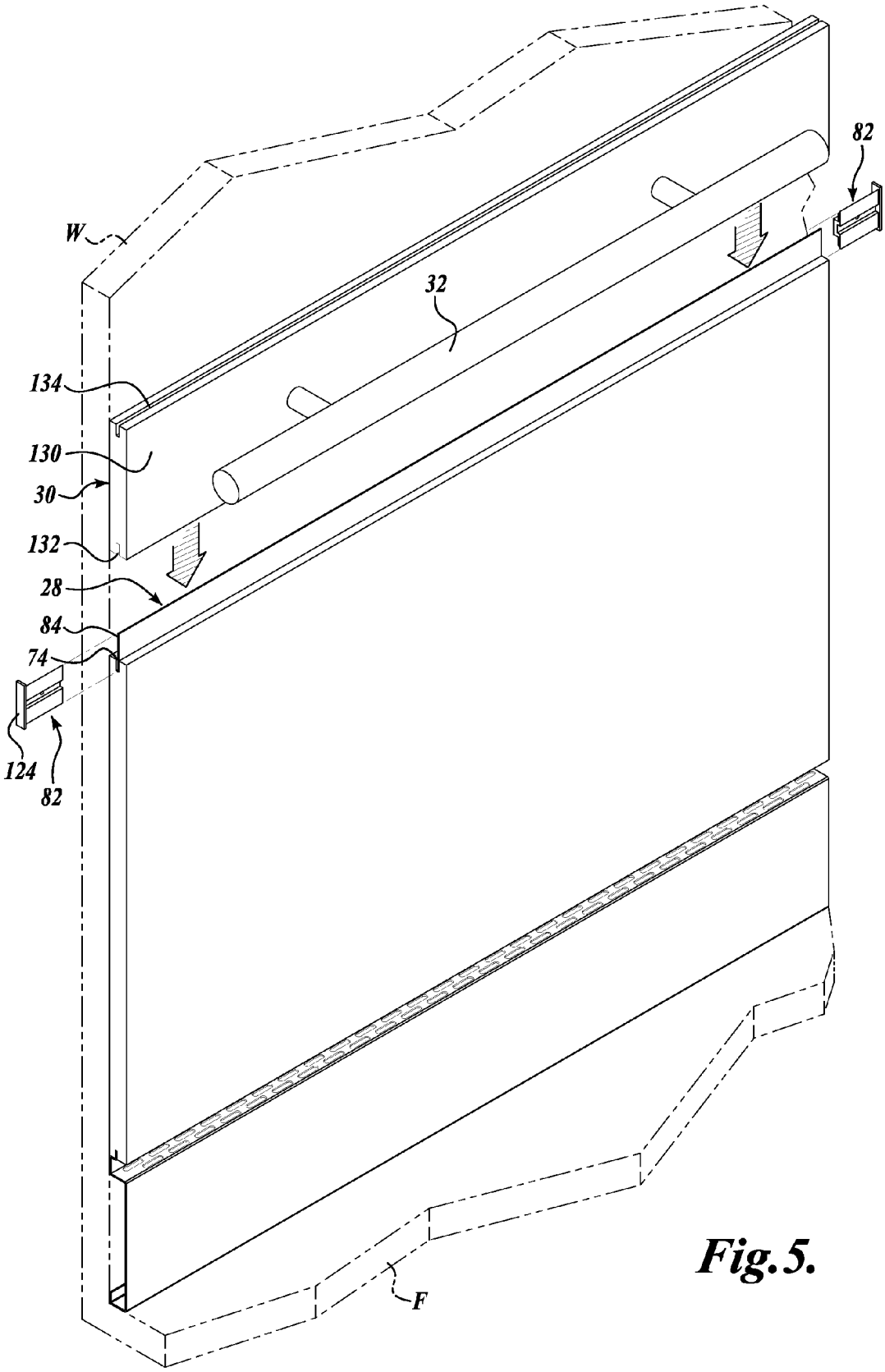
FIG. 5 is an isometric view of the base pan mated with the first wall panel of FIG. 2 and the first spline assembly of FIG. 4 mated with the first wall panel, and further a second wall panel being mated with the first spline assembly.

Referring to FIGS. 4 and 5, a spline 80 is configured to mate with the first top groove 74 of the first wall panel 26. More specifically, with the inner wall engaging surface 92 of the central rectangular portion 90 engaging the wall W, the first lateral tongue 102 is slidable downwardly within the first top groove 74 of the first wall panel 26. The first tapered edge 108 of the first lateral tongue 102 helps guide the first lateral tongue 102 into the first top groove 74. With the first lateral tongue 102 received within the first top groove 74, fasteners may be passed through the holes 120 in the spline 80 and into the wall W to secure the spline 80 to the wall W. As such, with the first lateral tongue 102 received within the first top groove 74, the spline 80 secures the first wall panel 26 to the wall W.

The spline 80 may have a length such that it extends along a majority of the length of the upper edge of the first wall panel 26. However, it should be appreciated that multiple splines 80 of shorter length having substantially identical cross section may instead be used. Using multiple splines 80 of shorter length rather than an elongated, single spline 80 would enable the splines 80 to be used with a variety of different wall panel system configurations, thereby increasing its versatility and use.

As shown in FIGS. 4 and 5, the first spline assembly 28 further includes an elongated cover plate 84 that has a length substantially equal to the length of the top groove 74, and a height substantially equal to the height of the spline 80. The cover plate 84 is suitably thin such that it may be received within the top groove 74 when the first lateral tongue 102 of the spline 80 is also received therein. With the first cover plate 84 received within the top groove 74 in this manner, the cover plate 84 covers the spline 80 and any fasteners received therein. The cover plate 84 further creates an accent strip between adjacent wall panels. In this regard, the cover plate 84 may be made of any suitable or desired material, such as stainless steel.

The first spline assembly 28 further includes end caps 82 that are configured to cover the ends of the spline 80 and the cover plate 84 when received within the top groove 74. Referring to FIGS. 7 and 8, the end cap 82 includes an elongated body portion 122 having a substantially uniform cross section that is substantially identical to the cross section of the spline 80. For ease of reference and clarity, features of the body portion 122 of the end cap 82 have been labeled in FIGS. 7 and 8 with the same references numerals as used for the spline 80 except they are marked with a prime (').

The end cap 82 also includes a transverse end portion 124 secured to an end of the elongated body 122. The transverse end portion 124 is preferably rectangular in shape, with a first elongated edge 138 being substantially flush with the wall-engaging surface 94' of the central rectangular portion 90'. A second opposing elongated edge 140 of the transverse end portion 124 is offset from the first and second outer tongue surfaces 110' and 116' of the first and second lateral tongues 102' and 104' so that the transverse end portion 124 defines an elongated shoulder 142. The elongated shoulder 142 is configured to cover the edge of the cover plate 84 (see FIGS. 4 and 5) when the cover plate 84 is positioned against the first and second outer tongue surfaces 110' and 116'.

Referring again to FIGS. 4 and 5, the end cap 82 is receivable within the first top groove 74 in a manner substantially similar to the spline 80. More specifically, with the inner wall engaging surface 92' of the central rectangular portion 90' engaging the wall W, the first lateral tongue 102' is slidably receivable within the first top groove 74 of the first wall panel 26. With the first lateral tongue 102' received within the first top groove 74, fasteners may be passed through the holes 120' in the end cap 82 and into the wall W to secure the end cap 82 to the wall W.

As can be seen in FIGS. 4 and 5, the body portion 122 of each end cap 82 may essentially form an extension of the spline 80 to cover the ends of the spline 80. Moreover, the body portion 122 of each end cap 82 is received within the first top groove 74 such that the transverse end portion 124 abuts against the ends of the first wall panel 26 and covers the ends of the cover plate 84. Thus, the end caps 82 cover any rough, sharp, or otherwise unfinished end of the spline 80 and cover 84. Furthermore, the end caps 82 define an aesthetically pleasing finish for the ends of the first top groove 74.

Referring to FIG. 5, the spline 80, end caps 82, and cover plate 84 of the first spline assembly 28 are receivable within a second bottom groove 132 of a second wall panel 30 to secure the second wall panel 30 to the first wall panel 26. The second wall panel 30 includes a substantially rectangular second wall panel body 130 made of any suitable material, such as wood or a wood composite. As stated above, the second wall panel 30 may include a handrail 32 secured to the second wall panel body 130 in a manner well known in the art. The second wall panel body 130 includes a substantially flat inner surface such that it may be positioned against and secured to the wall W.

The second wall panel body 130 defines a bottom elongated surface (not shown), and a second bottom groove 132 is formed along the length of the bottom elongated surface. Preferably, the first bottom groove 72 is formed in substantially the center of the bottom elongated surface to provide structural integrity at the intersection of the second wall panel body 130 and the first spline assembly 28. As can be seen in FIG. 5, with the second wall panel body 130 positioned against the wall W, the second wall panel 30 may be slid downwardly until the second bottom groove 132 engages and mates with the spline 80, end caps 82, and cover plate 84 of the first spline assembly 28 to secure the second wall panel 30 with the first wall panel 26.

The second wall panel 30 further includes a second top groove 134 extending along the length of the top surface of the second wall panel body 130. The second top groove 134 is sized and configured to mate with a second spline assembly 34 having a spline 80, end caps 82, and a cover plate 84, in substantially the same manner described above with reference to the first spline assembly 28.

Figure 6:
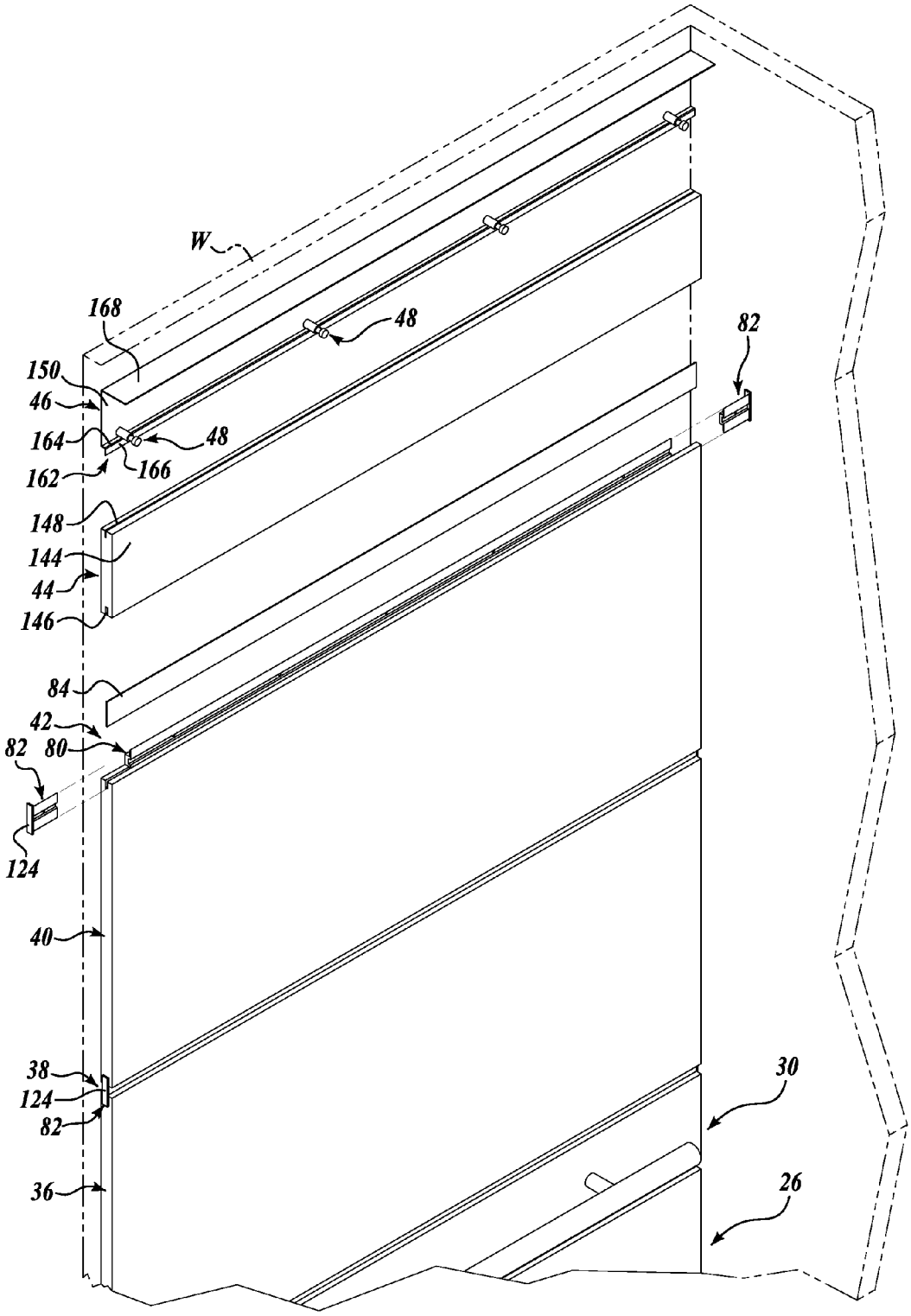
FIG. 6 is an isometric view of a portion of the wall panel system of FIG. 1, wherein a plurality of wall panels are shown mated with a plurality of spline assemblies, and wherein a top wall panel is shown being mated along its bottom edge with a spline assembly, and wherein the top wall panel is shown being mated along its top edge with a frieze, and wherein the frieze is shown with a plurality of pad stud assemblies.

Referring to FIG. 6, the third wall panel 36 is secured to the second wall panel through the second spline assembly 34 in substantially the same manner described above with reference to the first and second wall panels 26 and 30 and the first spline assembly 28. Similarly, a fourth wall panel 40 is secured to the third wall panel 36 with a third spline assembly 38, and a fifth wall panel 44 is secured to the fourth wall panel 40 with a fourth spline assembly 42. Fewer or more than four wall panels may instead be used to define the wall panel system 20.

The fifth or uppermost wall panel 44 includes a fifth wall panel body 144 similar to the first and second wall panels 26 and 30 described above. More specifically, the fifth wall panel 44 includes a fifth bottom groove 146 formed along a bottom surface of the fifth wall panel body 144 and a fifth top groove 148 formed along a top surface of the fifth wall panel body 144. The fifth wall panel 44 is mateable with the fifth spline assembly 42 through the fifth bottom groove 146, as noted above. The fifth top groove 148 of the fifth wall panel 44 is mateable with a frieze tab 162 defined on the frieze 46.

It should be appreciated that the grooves formed in the wall panels 26, 30, 36, 40, and 44 need not extend along the entire length of the top and bottom surfaces of the wall panels. Rather, the grooves may extend along only a portion thereof, or multiple grooves may instead be formed along different portions of the top and bottom surfaces. In that regard, the tongues of the base pan 24 and frieze 46 may also be defined along only a portion of the base pan 24 and frieze 46 or along multiple portions thereof. However, it can be appreciated that forming the groove or tongue along only portions of length may be more difficult to manufacture, thereby increasing costs. Moreover, by instead forming the grooves and tongues along the entire length of the wall panels, base pan, and frieze, the components are more easily adaptable for use in a variety of different configurations of wall panel systems.

The frieze 46 is an elongated structure having a substantially constant cross-section that is made of a suitable material, such as stainless steel or plastic. The frieze 46 includes a substantially flat, elongated frieze body 150 that is configured to lie substantially flat against the wall W. The frieze tab 162 is defined along a bottom edge of the frieze body 150, and it includes a horizontal portion 164 extending substantially transversely from the lower edge of the frieze body 150 away from the wall W. The frieze tab 162 further includes a vertical portion 166 extending substantially transversely downwardly from an outer edge of the horizontal portion 164. The horizontal portion 164 is of a predetermined depth to position the vertical portion 166 to engage the fifth top groove 148 in the fifth wall panel 144. The frieze 46 further includes a sight guard 168 extending substantially transversely from the upper edge of the frieze body 150 away from the wall W. The sight guard 168 is configured to interface with a ceiling panel or another suitable structure to conceal any unfinished ceiling surface of the elevator.

Figure 9:
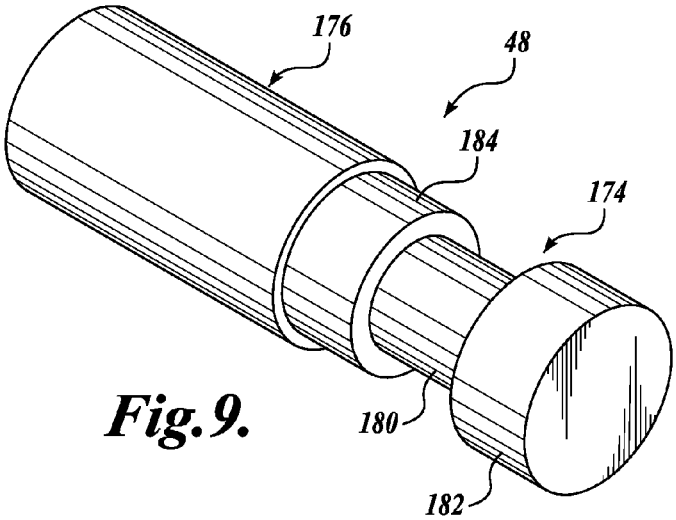
FIG. 9 is an isometric top view of a pad stud assembly formed in accordance with a preferred embodiment of the present disclosure.
Figure 10:
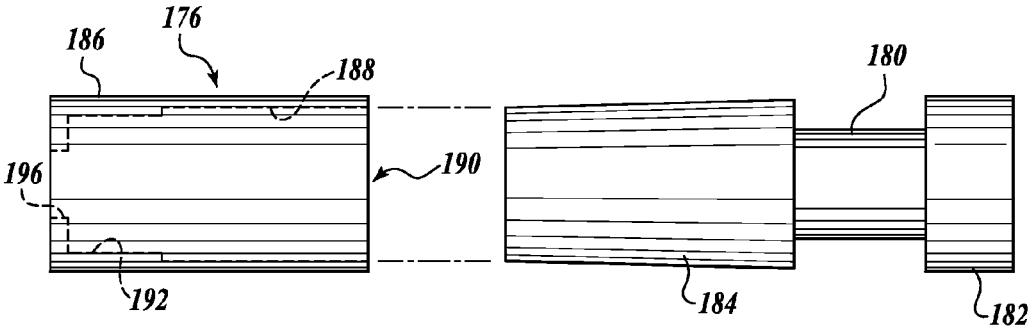
FIG. 10 is a side view of the pad stud assembly of FIG. 9.

Although the frieze 46 is substantially held in its position against the wall W by mating the frieze tab 162 with the fifth top groove 148, a plurality of pad stud assemblies 48 may additionally be used to secure the frieze 46 to the wall W. Referring to FIGS. 9 and 10, each pad stud assembly 48 includes a pad stud 174 received within a pad stud receiving portion 176. The pad stud 174 includes a pad hanging portion defined in part by a shaft 180 that may be any suitable shape, such as cylindrical. An enlarged head 182 is formed at one end of the shaft 180 that may also be any suitable shape, such as cylindrical.

The pad stud 174 further includes a tapered body 184 extending from an opposite end of the shaft 180 that is substantially frusto-conical in shape and tapers in size as the tapered body 184 extends away from the shaft 180. Both the tapered body 184 and the head 182 preferably have a cross-sectional diameter greater than the shaft 180 such that a pad attachment member (such as a hook or loop) may be retained on the shaft 180 to hang a pad from the pad stud 174, as is well known in the art.

As noted above, the pad stud 174 is receivable within a pad stud receiving portion 176. The pad stud receiving portion 176 includes a cylindrical body 186 having a central opening 190 defined in part by a stud-receiving cavity 188 extending from a first end of the cylindrical body 186. The cross-sectional diameter of the stud-receiving cavity 188 is sized to tightly receive at least a portion of the tapered body 184 of the pad stud 174 therein.

The central opening 190 is further defined by a fastener head receiving cavity 192 that extends from and is in communication with the stud-receiving cavity 188. The fastener head receiving cavity 192 is preferably smaller in cross-sectional diameter than the stud-receiving cavity 188. In this manner, a shoulder is defined between the stud-receiving cavity 188 and the fastener head receiving cavity 192 to limit the inward movement of the pad stud receiving portion 176 when received within the stud-receiving cavity 188. It should be appreciated that the fastener head receiving cavity 192 may instead be the same cross-sectional diameter as the stud-receiving cavity 188, wherein the inward movement of the pad stud receiving portion 176 is instead limited by the head of a fastener when received within the central opening 190, as will be hereinafter described.

The fastener head receiving cavity 192 is of a diameter that is sized to receive a head of a fastener (such as a screw) therein. In this regard, the central opening 190 is further defined by a fastener shaft opening 196 that extends from the fastener head receiving cavity 192. The fastener shaft opening 196 is smaller in cross-sectional diameter than the fastener head receiving cavity 192 to define a shoulder therebetween. As such, when a shaft of a fastener (not shown) is passed through the fastener shaft opening 196, the head of the fastener will be retained within the fastener head receiving cavity 192.

As noted above, the pad stud assemblies 48 may be used to help secure the frieze 46 to the wall W. Referring also to FIG. 6, a plurality of holes (not shown) may be formed within the frieze body 150 and spaced along the length of the frieze body 150. A pad receiving portion 176 of each pad stud assembly 48 may be aligned within the holes in the frieze body 150 such that a fastener may be passed through the central opening 190 in the pad receiving portion and through the hole in the frieze body 150. The fastener may thereafter be drilled into a pre-drilled hole or otherwise fastened to the wall W, thereby securing the frieze 46 to the wall W. It should be appreciated that the pad receiving portion 176 may be integrally formed with or otherwise secured to the frieze body 150, such as by welding, or the pad receiving portion 176 may instead be a separate component that is securable to the frieze body 150 through the fastener.

As stated above, the fastener is received within the pad receiving portion 176 such that the fastener shaft passes through the fastener shaft opening 196 and the head is received within the fastener head receiving cavity 192. In this manner, the tapered body 184 of the pad stud 174 may be tightly received within the stud-receiving cavity 188 to conceal the fastener within the pad receiving portion 176. Moreover, a portion of the tapered body 184, the shaft 180, and the head 182 extend from the pad receiving portion 176 to define a pad hanging portion for a pad attachment member (such as a grommet, hook, or loop). Thus, the pad stud assembly 48 secures the frieze 46 to the wall W and provides a mechanism for hanging a pad on the interior of the elevator, while concealing any fasteners used to secure the frieze 46 to the wall W.

As can be appreciated from the foregoing, the wall panel system 20 provides components for easily mounting wall panels and trim features to a wall or similar surface. The components of the wall panel system 20 can be built from the ground up by securing each panel to an adjacent panel through a versatile, independently mountable, durable spline assembly. The wall panel system 20 does not require the intensive labor of mounting cleats to specific locations on the wall to accurately align with correspondingly-shaped cleats formed on the wall panel. Moreover, by using a separate spline assembly to secure the wall panels together, the wall panels do not require a tongue that is susceptible to breaking off. Rather, the tongues may be defined on the separate, more durable spline assembly. Moreover, the base pan 24 and frieze 46, which can also be made from a sturdy, more durable material, include a tab for mating with the wall panels.

It should further be appreciated that the components of the wall panel system 20 may be further secured to or otherwise sealed against the wall W by first disposing a double-sided adhesive strip, caulking, etc., between the wall W and the base pan 24, wall panels, or frieze 46 of the wall panel system 20. Moreover, although the components of the wall panel system 20 are described as being assembled from the "ground up," it should be appreciated that the wall panel system 20 may be assembled in any order and in any suitable manner. Thus, while illustrative embodiments have been illustrated and described, it will be appreciated that various changes can be made therein without departing from the spirit and scope of the present disclosure.

The embodiments of the disclosure in which an exclusive property or privilege is claimed are defined as follows:

1. A wall panel system, comprising:

(a) a first wall panel having an inner surface and an outer surface, a first groove extending along a first end portion between the inner and outer surfaces, and a second groove extending along a second end portion between the inner and outer surfaces of the first wall panel, wherein the inner surface of the first wall panel is positioned against a wall;

(b) a second wall panel having an inner surface, an outer surface, and a third groove extending along a third end portion between the inner and outer surfaces of the second wall panel, wherein the inner surface of the second wall panel is positioned against the wall; and (c) a spline, comprising:

(i) a central polygonal portion having an inner surface, an outer surface in a spaced relationship with the inner surface, a first lateral surface extending from the outer surface toward the inner surface, and a second lateral surface extending from the outer surface toward the inner surface;

(ii) a first spline tongue extending outwardly from the first lateral surface, the first spline tongue defining an inner surface and an outer surface, wherein the outer surface of the first spline tongue is substantially coplanar with the outer surface of the central polygonal portion, a second spline tongues tongue extending outwardly from the second lateral surface, the second spline tongue defining an inner surface and an outer surface, wherein the outer surface of the second spline tongue is substantially coplanar with the outer surface of the central polygonal portion and the outer surface of the first spline tongue, wherein the first spline tongue is mateable mated with the first groove of the first wall panel and wherein the second spline tongue is mateable mated with the third groove of the second wall panel, and wherein the inner surface of the central polygonal portion is positioned against the wall; and (iii) a spline recess defined within the outer surface of the central polygonal portion between the first and second spline tongues such that the spline recess extends from the outer surface toward the inner surface of the central polygonal portion, wherein at least one fastener is received within at least one opening defined in the spline recess such that a portion of the at least one fastener is housed in the recess.

2. The panel system of claim 1, further comprising a base pan including a base pan tab extending along an upper portion of the base pan, the base pan tab mateable with the second groove.

3. The system of claim 2, wherein the base pan further includes a vent portion extending along at least a portion of the length of the base pan.

4. The system of claim 1, further comprising a frieze having a frieze tab extending along a lower portion of the frieze, the frieze tab mateable with a fourth groove extending lengthwise along a fourth end portion of the second wall panel.

5. The system of claim 4, further comprising a pad stud assembly configured to secure the frieze to a wall portion.

6. The system of claim 5, wherein the pad stud assembly includes a pad stud receiving portion configured to selectively receive a portion of a pad stud.

7. The system of claim 6, wherein a fastener is receivable within an opening in the pad stud receiving portion such that a portion of the fastener may pass through the frieze for securing the frieze to a wall portion.

8. The system of claim 1, further comprising a cover plate configured to mate with the first groove of the first wall panel and the third groove of the second wall panel to enclose the portion of the fasteners housed in the spline recess.

9. The system of claim 8, further comprising an end cap, the end cap comprising:

(a) first and second end cap tongues, wherein the first end cap tongue is mateable with the first groove and the second end cap tongue is mateable with the third groove; and (b) a transverse end portion sized and shaped to cover an end of the spline and an end of the cover plate.

10. A method of assembling a wall panel system on a wall, the method comprising:

(a) providing a first wall panel having an inner surface and an outer surface, a first groove extending along a first end portion between the inner and outer surfaces, and a second groove extending along a second end portion between the inner and outer surfaces of the first wall panel, wherein the inner surface of the first wall panel is positioned against a wall;

an inner surface, an outer surface, and a third groove extending along a third end portion between the inner and outer surfaces of the second wall panel, wherein the inner surface of the second wall panel is positioned against the wall;

(c) providing a spline, comprising:

(i) a central polygonal portion having an inner surface, an outer surface in a spaced relationship with the inner surface, a first lateral surface extending from the outer surface toward the inner surface, and a second lateral surface extending from the outer surface toward the inner surface;

(ii) a first spline tongue extending outwardly from the first lateral surface, the first spline tongue defining an inner surface and an outer surface, wherein the outer surface of the first spline tongue is substantially coplanar with the outer surface of the central polygonal portion, a second spline tongues mateable with the first and third grooves tongue extending outwardly from the second lateral surface, the second spline tongue defining an inner surface and an outer surface, wherein the outer surface of the second spline tongue is substantially coplanar with the outer surface of the central polygonal portion and the outer surface of the first spline tongue;

(iii) a spline recess defined in the outer surface of the central polygonal portion between the first and second spline tongues such that the spline recess extends from the outer surface toward the inner surface of the central polygonal portion, wherein at least one fastener is receivable within at least one opening defined in the spline recess when the first and second spline tongues are mated with the first and third grooves such that a portion of the at least one fastener is housed in the recess;

(d) positioning the inner surface of the first wall panel against the wall (d) mating the first spline tongue with the first groove of the first wall panel such that the inner surface of the central polygonal portion is positioned against the wall;

(f) securing the spline to the wall by passing at least one fastener through the at least one opening in the spline recess; and (h) mating the second spline tongue with the third groove of the second wall panel.

11. The method of claim 10, further comprising providing a base pan having a base pan tab extending along an upper portion of the base pan and mating the base pan tab with the second groove.

12. The method of claim 10, further comprising providing a frieze having a frieze tab extending along a lower portion of the frieze and mating the frieze tab with a fourth groove extending lengthwise along a fourth end portion of the second wall panel.

13. The method of claim 12, further comprising securing the frieze to the wall with a pad stud assembly.

14. The method of claim 13, wherein the pad stud assembly includes a pad stud receiving portion having an opening and a pad stud partially receivable within the opening.

15. The method of claim 14, further comprising securing the frieze to the wall by passing a fastener through the opening in the pad stud receiving portion and through the frieze.

16. The method of claim 15, further comprising enclosing the fastener within the pad stud receiving portion by disposing a portion of the pad stud within the opening in the pad stud receiving portion.

17. The method of claim 14, further comprising enclosing the at least one fastener housed within the spline recess by mating a cover plate with the first groove of the first wall panel and the third groove of the second wall panel.

18. The system of claim 1, further comprising a base pan having a body, a first longitudinal edge extending along the body and a second longitudinal edge extending along the body, a first wall positioning portion extending along at least a portion of the first longitudinal edge, and a second wall positioning portion extending along at least a portion of the second longitudinal edge, the first and second wall positioning portions configured to position the body a predetermined distance from a wall to define a gap between the wall and the body, the base pan further including a vent portion configured to allow fluid to flow from the gap defined between the wall and the body.

19. The system of claim 18, wherein the first wall positioning portion includes the vent portion extending along at least a portion of the first longitudinal edge and substantially transversely from the body, a first wall engaging portion extending substantially transversely from the vent portion, a horizontal portion extending substantially transversely from the first wall engaging portion, and a vertical portion extending substantially transversely from the horizontal portion, and wherein the second wall positioning portion includes a floor engaging portion extending along at least a portion of the second longitudinal edge and substantially transversely from the body, and a second wall engaging portion extending substantially transversely from the floor engaging portion.

20. The system of claim 19, wherein the second wall positioning portion further comprises a horizontal portion extending substantially transversely from the second wall engaging portion and a vertical portion extending substantially transversely from the horizontal portion.

* * * * *

UNITED STATES PATENT AND TRADEMARK OFFICE

CERTIFICATE OF CORRECTION

PATENT NO. : 8,468,767 B1
APPLICATION NO. : 12/782559
DATED : June 25, 2013
INVENTOR(S) : S. J. McBride It is certified that error appears in the above-identified patent and that said Letters Patent is hereby corrected as shown below:

In the Claims

| COLUMN | LINE | ERROR |
|---|---|---|
| 10 (Claim 1, line 26) | 39 | after "spline" delete "tongues" |
| 10 (Claim 1, line 32) | 45 | after "tongue is" delete "mateable" |
| 10 (Claim 1, line 34) | 47 | after "tongue is" delete "mateable" |
| 12 (Claim 10, line 45) | 3 | "(d)" should read --(e)-- |
| 12 (Claim 10, line 51) | 9 | "(h)" should read --(g)-- |

Signed and Sealed this
Thirty-first Day of December, 2013

Margaret A. Focarino

Margaret A. Focarino
*Commissioner for Patents of the United States Patent and Trademark Office*